United States Patent [19]

Berelson

[11] Patent Number: 4,462,967

[45] Date of Patent: Jul. 31, 1984

[54] POWDER DISPENSER

[76] Inventor: Rudolph Berelson, Treelawns, 34 Fallowfield, Stanmore Hill, Stanmore, Middlesex, England

[21] Appl. No.: 348,712

[22] Filed: Feb. 16, 1982

[30] Foreign Application Priority Data

Feb. 13, 1981 [GB] United Kingdom ..... 8104483

[51] Int. Cl.[3] ..... B01D 11/02

[52] U.S. Cl. ..... 422/269; 134/93; 134/172; 134/177; 134/198

[58] Field of Search ..... 422/264, 269, 271, 273, 422/276–279, 106, 275; 222/67; 134/93, 172, 175, 177, 198

[56] References Cited

U.S. PATENT DOCUMENTS

| | | | |
|---|---|---|---|
| 1,246,556 | 11/1917 | Crow | 134/93 X |
| 1,262,717 | 4/1918 | Vaudreuil | 422/278 X |
| 1,307,329 | 6/1919 | Trent | 422/278 X |
| 1,823,583 | 9/1931 | Biskamp | 134/177 |
| 1,846,098 | 2/1932 | Goodloe | 422/275 X |
| 2,371,720 | 3/1945 | Stine | 134/93 X |
| 2,387,945 | 10/1945 | McDow | 422/278 X |
| 2,663,553 | 12/1953 | Booth | 422/278 X |
| 2,758,877 | 8/1956 | Gleason | 422/278 X |
| 3,574,561 | 4/1971 | Nickerson et al. | 422/106 |
| 3,595,438 | 7/1971 | Daley et al. | 222/67 |
| 4,020,865 | 5/1977 | Moffat et al. | 222/67 X |
| 4,063,663 | 12/1977 | Larson et al. | 222/67 X |

FOREIGN PATENT DOCUMENTS 1105696 12/1955 France .

*Primary Examiner*—Richard L. Chiesa

*Attorney, Agent, or Firm*—Fleit, Jacobson, Cohn & Price

[57] ABSTRACT

In a powder dispenser comprising a container in which powder is supported on a screen, water under pressure for forming a concentrated solution or dispersion with the powder is introduced into a tube beneath the screen. The tube contains a plurality of apertures along its length and is rotatably mounted substantially mid-length so that an upwardly directed spray of water is directed from the tube through the screen onto the bottom layers of powder thereon with a sprinkler effect as the tube is rotated. Tube rotation is preferably imparted automatically under the reaction forces of the water leaving the apertures which are offset from the vertical in opposite senses on each side of the rotary axis.

8 Claims, 2 Drawing Figures

POWDER DISPENSER

The invention relates to a powder dispenser primarily, but not exclusively, for supplying detergent to a dishwashing or degreasing or other cleaning machine.

Such machines are periodically fed with a concentrated detergent solution, which may be caustic. This solution is desirably prepared in situ from detergent powder to which water is added and the solution is then metered to the adjacent machine. For numerous reasons here not material, it is costlier and considerably disadvantageous to have the solution prepared in a factory and delivered in drums. However, liquid detergent dispensers are nevertheless predominantly employed in practice because entirely satisfactory powder dispensers have not yet been perfected, primarily because of the difficulty of forming a reasonably uniform suspension of the powder in water to give a uniform concentration of detergent solution.

In most known forms of powder dispensers, a solenoid valve for adding water to the detergent powder in a reservoir is actuated whenever a probe indicates that the detergent concentration in the machine has dropped below a predetermined minimum. The resulting concentrated detergent solution is fed to the machine where it is required until the probe shuts off the solenoid valve again. In the dispenser, the water can be added so as to immerse the powder in the reservoir completely but this fails to result in a uniformly concentrated solution because fresh water continues to be added as concentrated solution is being drawn off.

It has therefore been suggested that the powder be supported in the reservoir on a flat screen of suitable mesh size and that the water be directed from beneath the screen from a plurality of nozzles to dissolve and flush the undermost powder layers through the screen for delivery to the point of use. This results in a more uniform concentration, as do constructions in which a single spray-forming nozzle or hose is directed onto the concave side of a part-spherical or conical powder-supporting screen in a cylindrical reservoir (U.S. Pat. Nos. 4,063,663, 3,595,438 and 4,020,865).

However, different problems arise in reservoirs with screens, primarily because the water sprayed unevenly penetrates through the screen and into the powder, thereby forming channels and moistening the adjacent powder that is not carried away in rivulets but instead forms cakes or solidified particles which subsequently tend to clog the screen. This phenomenon is aggravated in hard water regions where it is most likely that some of the spray holes in the nozzle become blocked by calcium carbonate deposits and the powder is then no longer evenly impinged over most of the screen area from the remaining spray holes.

The invention aims to provide a simply constructed powder dispenser which is improved in the above-mentioned respects.

According to the invention, in a powder dispenser comprising a container in which the powder is supported on a screen, water under pressure for forming a concentrated solution or dispersion with the powder is introduced into a tube beneath the screen, which tube is provided with a plurality of apertures along its length and is rotatably mounted substantially mid-length so that an upwardly directed spray of water is directed through the screen with a sprinkler effect.

An example of the invention is shown in the accompanying diagrammatic drawing, wherein.

Figure 1:
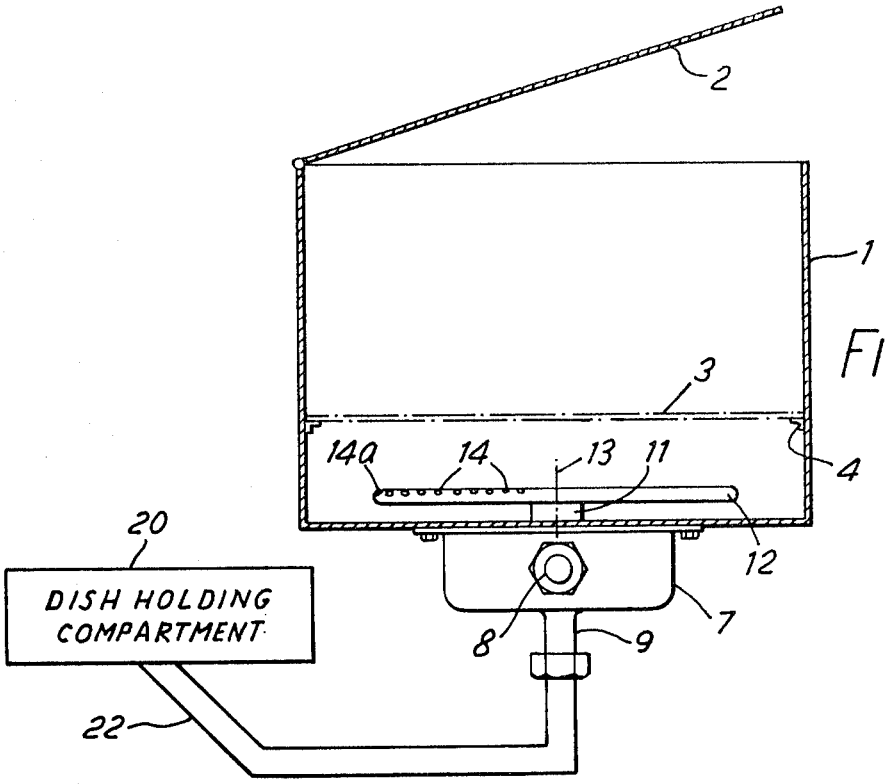
FIG. 1 is a part-sectional side elevation of a powder dispenser.
Figure 2:
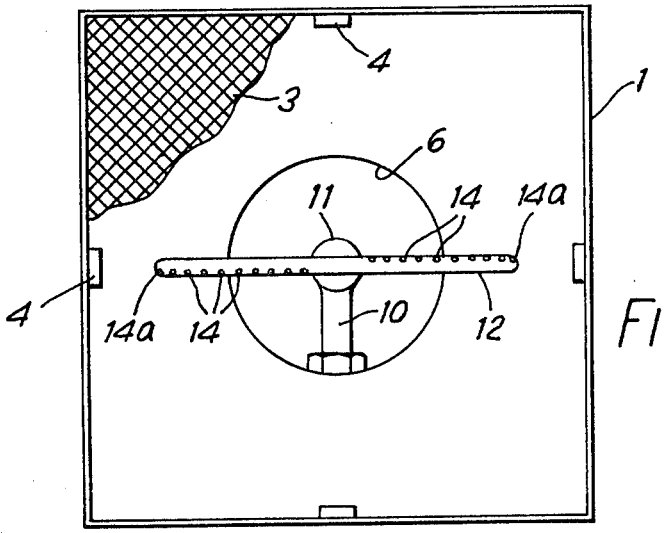
FIG. 2 is a plan view thereof with the lid removed and a screen partly broken away.

The powder dispenser comprises a container 1 for powder (not shown) which is introduced through a lid 2 and rests on a flat screen 3. The screen comprises a gauze of suitable mesh size and rests on projections or shoulders 4. It can be removed for replacement by a screen of different mesh. The base of the container has an opening 6 which is covered by a replaceable sump 7. This sump is provided with a water inlet connection 8 and a solution outlet connection 9.

The water inlet leads to a stationary pipe 10 carrying a hollow rotary bearing member 11 for a horizontal tube 12 which is closed at its ends and is rotatable about the vertical axis 13. The tube contains a plurality of spray holes 14 along its length, from which water jets are directed upwardly through the screen to reach the bottom layers of powder thereon. Rotation is preferably imparted to the tube 12 under the reaction forces of the water leaving the holes 14 in so far that the holes 14 on one side of the rotary axis 13 are directed at an angle to the vertical in one sense and the holes on the other side are also directed at an angle to the vertical but in the opposite sense.

Parts of the powder dispenser and the dishwashing machine for which it is intended but not relevant to the present invention have been omitted for the sake of simplicity. It suffices to say that, when the detergent concentration in the dishwasher is too low, as signalled by a probe, a solenoid valve initiates the supply of water under pressure to the inlet connection 8 of the dispenser with a view to metering concentrated detergent solution to the machine until the solenoid valve stops the water supply again. The water from the connection 8 flows through the pipe 10 into the tube and sets same into rotation as it emerges through the offset sets of holes 14 and is sprayed through the screen 3 onto the bottom of the powder. The concentrated detergent solution of powder in water flows back through the screen under gravity and out from sump 7 through connector 9 to the connector 22 and to main dishholding compartment 20 of a dishwasher apparatus. To assist the outflow of solution, the endmost holes **14*a* in the tube 12 may be directed so as to form wash-down jets which are directed onto the sides of the container 1 instead of passing through the screen 3**.

By means of the invention, a satisfactory uniform concentration of detergent solution is obtainable without fear of the screen becoming clogged or the powder above the screen settling unevenly as the bottom layers are washed away. Rotation of the sprinkler tube is achieved automatically and a large area of screen can be covered by the sprays which are flung further by reason of the centrifugal effect. In particular, it is not necessary to make the container cylindrical. Since the screen can be flat, it is cheap to make and it is easily replaceable. A collecting funnel for the resulting detergent solution is found to be unnecessary.

I claim:

1. A dishwashing apparatus including a powder dispenser in which dishwashing powder and water are mixed and pumped to a main dishholding compartment of a dishwasher in which dishes are to be cleansed, said apparatus comprising:

a housing defining a main dishholding compartment of a dishwasher;

a powder dispenser means including a container for holding powder having an inlet and an outlet;

means connecting said outlet for removal of a uniformly concentrated solution of dishwasher powder and water and transferring said uniformly concentrated solution from said container to the main dishholding compartment of the dishwasher for the cleansing of dishes in the dishwasher;

means connecting a source of water under pressure to the inlet of the container;

a substantially flat screen spanning the interior of said container for supporting the powder;

an elongated tube disposed within said container, beneath and substantially parallel to said screen;

a plurality of apertures directed towards said screen, spaced along the length of said tube;

rotary mounting means rotatably mounting said tube substantially mid-length of said tube and in fluid communication therewith; and means connecting the inlet to the rotary mounting means whereby water introduced under pressure at the inlet flows through the rotary mounting means to the tube and as the tube is rotated, an upwardly directed spray of water is directed from the tube through the screen, with a rotary sprinkler effect, to form the uniformly concentrated solution with powder retained on the screen.

2. A dispenser according to claim 1, further comprising means responsive to flow of water and effective to impart rotation to the tube whenever there is a flow of water therethrough.

3. A dispenser according to claim 2, wherein the apertures on one side of the rotary axis of the tube are directed at an angle to the vertical in one sense and on the other side at an angle to the vertical in the opposite sense, whereby rotation is imparted to the tube under the reaction forces of the water leaving the apertures.

4. A dispenser according to claim 1, wherein the container base has a hole constituting said outlet.

5. A dispenser according to claim 4, further comprising a sump into which said hole opens, said sump bring provided with an outlet connection for the solution.

6. A dispenser according to claim 5, further comprising a hollow rotary bearing member extending through said hole and constituting said rotary mounting means; and an inlet pipe extending into said sump and carrying said hollow rotary bearing member; the arrangement being such that water introduced through said inlet pipe under pressure flows to the tube by way of the hollow rotary bearing member.

7. A dispenser according to claim 1, wherein said screen is a flat gauze.

8. A dispenser according to claim 7, further comprising support shoulders within the container for replaceably supporting said flat gauze screen.

* * * * *